US005963897A

United States Patent [19]

Alpuente et al.

[11] Patent Number: 5,963,897

[45] Date of Patent: Oct. 5, 1999

[54] APPARATUS AND METHOD FOR HYBRID EXCITED LINEAR PREDICTION SPEECH ENCODING

[75] Inventors: Manel Guberna Alpuente, Barcelona, Spain; Jean-Francois Rasaminjanahary, Fandriana, Madagascar; Mohand Ferhaoui, Rouiba, Algeria; Dirk Van Compernolle, Korbeek-Dijle, Belgium

[73] Assignee: Lernout & Hauspie Speech Products N.V., Ypres, Belgium

[21] Appl. No.: 09/031,522

[22] Filed: Feb. 27, 1998

[51] Int. Cl.[6] ..... G10L 9/14

[52] U.S. Cl. ..... 704/219; 704/220; 704/262

[58] Field of Search ..... 704/219, 232, 704/229, 222, 220, 200, 262, 266, 223, 225

[56] References Cited

U.S. PATENT DOCUMENTS

| | | | |
|---|---|---|---|
| Re. 32,580 | 1/1988 | Atal et al. | 704/219 |
| 4,058,676 | 11/1977 | Wilkes et al. | 704/220 |
| 4,472,832 | 9/1984 | Atal et al. | 704/221 |
| 4,701,954 | 10/1987 | Atal | 381/49 |
| 4,709,390 | 11/1987 | Atal et al. | 704/262 |
| 4,847,905 | 7/1989 | Lefevre et al. | 704/222 |
| 5,293,448 | 3/1994 | Honda | 704/208 |
| 5,444,816 | 8/1995 | Adoul et al. | 704/219 |
| 5,495,556 | 2/1996 | Honda | 704/265 |
| 5,621,853 | 4/1997 | Gardner | 704/219 |
| 5,699,482 | 12/1997 | Adoul et al. | 704/219 |
| 5,752,223 | 5/1998 | Aoyagi et al. | 704/219 |
| 5,754,976 | 5/1998 | Adoul et al. | 704/223 |

OTHER PUBLICATIONS

Ananthapadmanabha, T., et al., "Epoch Extraction from Linear Prediction Residual for Identification of Closed Glottis Internal", *IEEE Transactions on Acoustics, Speech, and Signal Processing*, vol. ASSP–27, No. 4, Aug. 1979.

Atal, B., et al, "A New Model of LPC Excitation for Producing Natural–Sounding Speech at Low Bit Rates", *IEEE*, Ch. 1746, 1982.

Cohen, Jordan R., Analysis by Synthesis Revisited Parameterization of Speech I., *Communications ResearchDivision Working Paper*, Log. No. 80513, Jul. 1980.

Matusek, M., et al, "A New Approach to the Determination of the Glottal Waveform", *IEEE Transactions ofAcoustics, Speech and Signal Processing*, vol. ASSP 28, No. 6, Dec., 1980.

*Primary Examiner*—Richemond Dorvil
*Attorney, Agent, or Firm*—Bromberg & Sunstein LLP

[57] ABSTRACT

A method is given of encoding a speech signal using analysis-by-synthesis to perform a flexible selection of the excitation waveforms in combination with an efficient bit allocation. This approach yields improved speech quality compared to other methods at similar bit rates.

136 Claims, 4 Drawing Sheets

| FIG. 2A | FIG. 2B |
|---|---|

APPARATUS AND METHOD FOR HYBRID EXCITED LINEAR PREDICTION SPEECH ENCODING

FIELD OF THE INVENTION

This invention relates to speech processing, and in particular to a method for speech encoding using hybrid excited linear prediction.

BACKGROUND OF THE INVENTION

Speech processing systems digitally encode an input speech signal before additionally processing the signal. Speech encoders may be generally classified as either waveform coders or voice coders (also called vocoders). Waveform coders can produce natural sounding speech, but require relatively high bit rates. Voice coders have the advantage of operating at lower bit rates with higher compression ratios, but are perceived as sounding more synthetic than waveform coders. Lower bit rates are desirable in order to more efficiently use a finite transmission channel bandwidth. Speech signals are known to contain significant redundant information, and the effort to lower coding bit rates is in part directed towards identifying and removing such redundant information.

Speech signals are intrinsically non-stationary, but they can be considered as quasi-stationary signals over short periods such as 5 to 30 msec, generally known as a frame. Some particular speech features may be obtained from the spectral information present in a speech signal during such a speech frame. Voice coders extract such spectral features in encoding speech frames.

It is also well known that speech signals contain an important correlation between nearby samples. This redundant short term correlation can be removed from a speech signal by the technique of linear prediction. For the past 30 years, such linear predictive coding (LPC) has been used in speech coding, in which the coding defines a linear predictive filter representative of the short term spectral information which is computed for each presumed quasi-stationary segment. A general discussion of this subject matter appears in Chapter 7 of Deller, Proakis & Hansen, *Discrete-Time Processing of Speech Signals* (Prentice Hall, 1987), which is incorporated herein by reference.

A residual signal, representing all the information not captured by the LPC coefficients, is obtained by passing the original speech signal through the linear predictive filter. This residual signal is normally very complex. In early LPC coders, this complex residual signal was grossly approximated by making a binary choice between a white noise signal for unvoiced sounds, and a regularly spaced pulse signal for voiced sounds. Such approximation resulted in a highly degraded voice quality. Accordingly, linear predictive coders using more sophisticated encoding of the residual signal have been the focus of further development efforts.

All such coders could be classified under the broad term of residual excited linear predictive (RELP) coders. The earliest RELP coders used a baseband filter to process the residual signal in order to obtain a series of equally spaced non-zero pulses which could be coded at significantly lower bit rates than the original signal, while preserving high signal quality. Even this signal can still contain a significant amount of redundancy, however, especially during periods of voiced speech. This type of redundancy is due to the regularity of the vibration of the vocal cords and lasts for a significantly longer time span, typically 2.5–20 msec., than the correlation covered by the LPC coefficients, typically <2 msec.

In order to avoid the low speech quality of the original LPC coders and the simple baseband RELP coder's sub-optimal bit efficiency due to the limited flexibility of the residual modeling, many of the more recent speech coding approaches may be considered more flexible applications of the RELP principle, with a long-term predictor also included. Examples of such include the Multi-Pulse LPC arrangement of Atal, U.S. Pat. No. 4,701,954, the Algebraic Code Excited Linear Prediction arrangement of Adoul, U.S. Pat. No. 5,444,816, and the Regular-Pulse Excited LPC coder of the GSM standard.

SUMMARY OF THE INVENTION

A preferred embodiment of the present invention utilizes a very flexible excitation method suitable for a wide range of signals. Different excitations are used to accurately represent the spectral information of the residual signal, and the excitation signal is efficiently encoded using a small number of bits.

A preferred embodiment of the present invention includes an improved apparatus and method of creating an excitation signal associated with a segment of input speech. To that end, a spectral signal representative of the spectral parameters of the segment of input speech is formed, composed, for instance, of linear predictive parameters. A set of excitation candidate signals is created, the set having at least one member, each excitation candidate signal comprised of a sequence of single waveforms, each waveform having a type, the sequence having at least one waveform, wherein the position of any single waveform subsequent to the first single waveform is encoded relative to the position of a preceding single waveform. In a further embodiment, selected parameters indicative of redundant information in the segment of input speech may be extracted from the segment of input speech. In such an embodiment, members of the set of excitation candidate signals created may be responsive to such selected parameters.

The first single waveform may be positioned with respect to the beginning of the segment of input speech. The relative positions of subsequent waveforms may be determined dynamically or by use of a table of allowable positions. The single waveforms may be glottal pulse waveforms, sinusoidal period waveforms, single pulses, quasi-stationary signal waveforms, non-stationary signal waveforms, substantially periodic waveforms, speech transition sound waveforms, flat spectra waveforms or non-periodic waveforms. The types of single waveforms may pre-selected or dynamically selected, for instance, according to an error signal. The number and length of single waveforms may be fixed or variable. In the event that a single waveform extends beyond the end of the current segment of input speech, the overflowing portion of the waveform may be applied to the beginning of the current segment, to the beginning of the next segment, or ignored altogether.

A set of error signals is formed, the set having at least one member, each error signal providing a measure of the accuracy with which the spectral signal and a given one of the excitation candidate signals encode the input speech segment. An excitation candidate signal is selected as the excitation signal when the corresponding error signal is indicative of sufficiently accurate encoding. If no excitation signal is selected, a set of new excitation candidate signals is recursively created as before wherein the position of at least one single waveform in the sequence of at least one excitation candidate signal is modified in response to the set of error signals. Members of the set of new excitation candidate signals are then processed as described above.

A preferred embodiment of the present invention includes another improved apparatus and method of creating an excitation signal associated with a segment of input speech. To that end, a spectral signal representative of the spectral parameters of the segment of input speech is formed, composed, for instance, of linear predictive parameters. The segment of input speech is then filtered according to the spectral signal to form a perceptually weighted segment of input speech. A reference signal representative of the segment of input speech is produced by subtracting from the perceptually weighted segment of input speech a signal representative of any previously modeled excitation sequence of the current segment of input speech. A set of excitation candidate signals is created, the set having at least one member, each excitation candidate signal comprised of a sequence of single waveforms, each waveform having a type, the sequence having at least one waveform, wherein the position of any single waveform subsequent to the first single waveform is encoded relative to the position of a preceding single waveform. In a further embodiment, selected parameters indicative of redundant information in the segment of input speech may be extracted from the segment of input speech. In such an embodiment, members of the set of excitation candidate signals created may be responsive to such selected parameters.

The first single waveform may be positioned with respect to the beginning of the segment of input speech. The relative positions of subsequent waveforms may be determined dynamically or by use of a table of allowable positions. The single waveforms may be glottal pulse waveforms, sinusoidal period waveforms, single pulses, quasi-stationary signal waveforms, non-stationary signal waveforms, substantially periodic waveforms, speech transition sound waveforms, flat spectra waveforms or non-periodic waveforms. The types of single waveforms may pre-selected or dynamically selected, for instance, according to an error signal. The number and length of single waveforms may be fixed or variable. In the event that a single waveform extends beyond the end of the current segment of input speech, the overflowing portion of the waveform may be applied to the beginning of the current segment, to the beginning of the next segment, or ignored altogether.

Members of the set of excitation candidate signals are combined with the spectral signal, for instance in a synthesis filter, to form a set of synthetic speech signals, the set having at least one member, each synthetic speech signal representative of the segment of input speech. Members of the set of synthetic speech signals may be spectrally shaped to form a set of perceptually weighted synthetic speech signals, the set having at least one member. A set of error signals is formed, the set having at least one member, each error signal providing a measure of the accuracy with which the given members of the set of perceptually weighted synthetic speech signals encode the input speech segment. An excitation candidate signal is selected as the excitation signal when the corresponding error signal is indicative of sufficiently accurate encoding. If no excitation signal is selected, a set of new excitation candidate signals is recursively created as before wherein the position of at least one single waveform in the sequence of at least one excitation candidate signal is modified in response to the set of error signals. Members of the set of new excitation candidate signals are then processed as described above.

Another preferred embodiment of the present invention includes an apparatus and method of creating an excitation signal associated with a segment of input speech. To that end, a spectral signal representative of the spectral parameters of the segment of input speech is formed, composed, for instance, of linear predictive parameters. A set of excitation candidate signals composed of elements from a plurality of sets of excitation sequences is created, the set having at least one member, wherein each excitation sequence is comprised of a sequence of single waveforms, each waveform having a type, the sequence having at least one waveform, wherein the position of any single waveform subsequent to the first single waveform is encoded relative to the position of a preceding single waveform. In one embodiment, at least one of the plurality of sets of excitation sequences is associated with preselected redundancy information, for example, pitch related information. In such an embodiment, members of the set of excitation candidate signals created may be responsive to such selected parameters.

The first single waveform may be positioned with respect to the beginning of the segment of input speech. The relative positions of subsequent waveforms may be determined dynamically or by use of a table of allowable positions. The single waveforms may be glottal pulse waveforms, sinusoidal period waveforms, single pulses, quasi-stationary signal waveforms, non-stationary signal waveforms, substantially periodic waveforms, speech transition sound waveforms, flat spectra waveforms or non-periodic waveforms. The types of single waveforms may pre-selected or dynamically selected, for instance, according to an error signal. The number and length of single waveforms may be fixed or variable. In the event that a single waveform extends beyond the end of the current segment of input speech, the overflowing portion of the waveform may be applied to the beginning of the current segment, to the beginning of the next segment, or ignored altogether.

A set of error signals is formed, the set having at least one member, each error signal providing a measure of the accuracy with which the spectral signal and a given one of the excitation candidate signals encode the input speech segment. An excitation candidate signal is selected as the excitation signal when the corresponding error signal is indicative of sufficiently accurate encoding. If no excitation signal is selected, a set of new excitation candidate signals is recursively created as before wherein the position of at least one single waveform in the sequence of at least one excitation candidate signal is modified in response to the set of error signals. Members of the set of new excitation candidate signals are then processed as described above.

BRIEF DESCRIPTION OF THE DRAWINGS

The foregoing and other objects and advantages of the invention will be appreciated more fully from the following further description thereof with reference to the accompanying drawings wherein.

DETAILED DESCRIPTION AND PREFERRED EMBODIMENTS

A preferred embodiment of the present invention generates an excitation signal which is constructed such that, in combination with a spectral signal that has been passed through a linear prediction filter, it generates an acceptably close recovery of the incoming speech signal. The excitation signal is represented as a sequence of elementary waveforms, where the position of each single waveform is encoded relative to the position of the previous one. For each single waveform, such a relative, or differential, position is quantised using its appropriate pattern which can be dynamically changed in either the encoder or the decoder. The relative waveform position and an appropriate gain value of each waveform in the excitation sequence are transmitted along with the LPC coefficients.

The general procedure to find an acceptable excitation candidate is as follows. Different excitation candidates are investigated by calculating the error caused by each one. The candidate is selected which results in an acceptably small weighted error. In terms of an analysis-by-synthesis conception, the relative positions (and, optionally, the amplitudes) of a limited number of single waveforms are determined such that the perceptually weighted error between the original and the synthesized signal is acceptably small. The method used to determine the amplitudes and positions of each single waveform determines the final signal-to-noise ratio (SNR), the complexity of the global coding system, and, most importantly, the quality of the synthesized speech.

In a preferred embodiment, excitation candidates are generated as a sequence of single waveforms of variable sign, gain, and position where the position of each single waveform in the excitation frame depends on the position of the previous one. That is, the encoding uses the differential value between the "absolute" position for the previous waveform and the "absolute" position for the current one. Consequently, these waveforms are subjected to the absolute position of the first single waveform, and to the sparse relative positions allowed to subsequent single waveforms in the excitation sequence. The sparse relative positions are stored in a different table for each single waveform. As a result, the position of each single waveform is constrained by the positions of the previous ones, so that positions of single waveforms are not independent. The algorithm used by a preferred embodiment allows the creation of excitation candidates in which the first waveform is encoded more accurately than subsequent ones, or, alternatively, the selection of candidates in which some regions are relatively enhanced with respect to the rest of the excitation frame.

Figure 1:
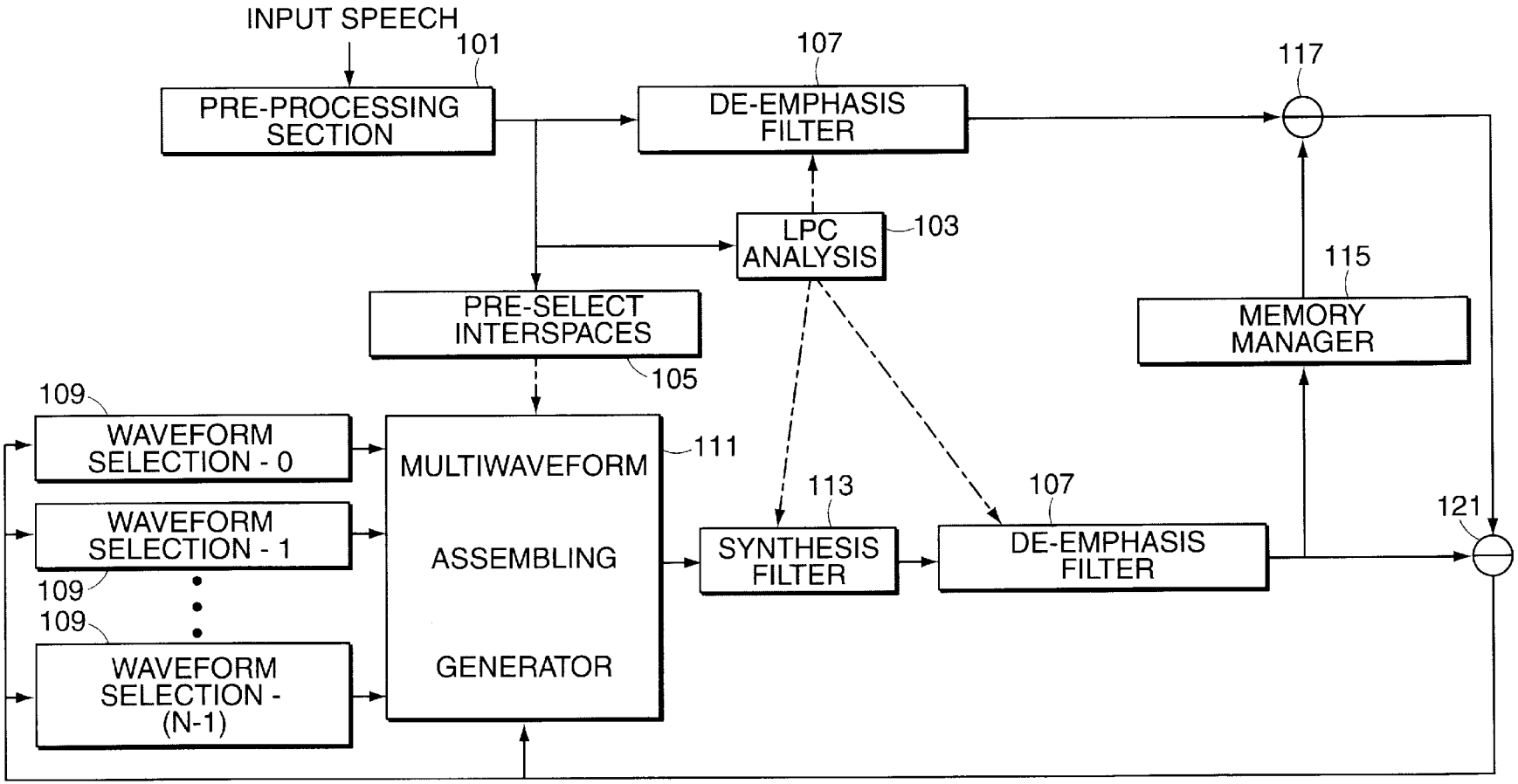
FIG. 1 is a block diagram of a preferred embodiment of the present invention.

FIG. 1 illustrates a speech encoder system according to a preferred embodiment of the present invention. The input speech is pre-processed at the first stage 101, including acquisition by a transducer, sampling by an analog-to-digital sampler, partitioning the input speech into frames, and removing of the DC signal using a high-pass filter.

Figures 2, 2A:
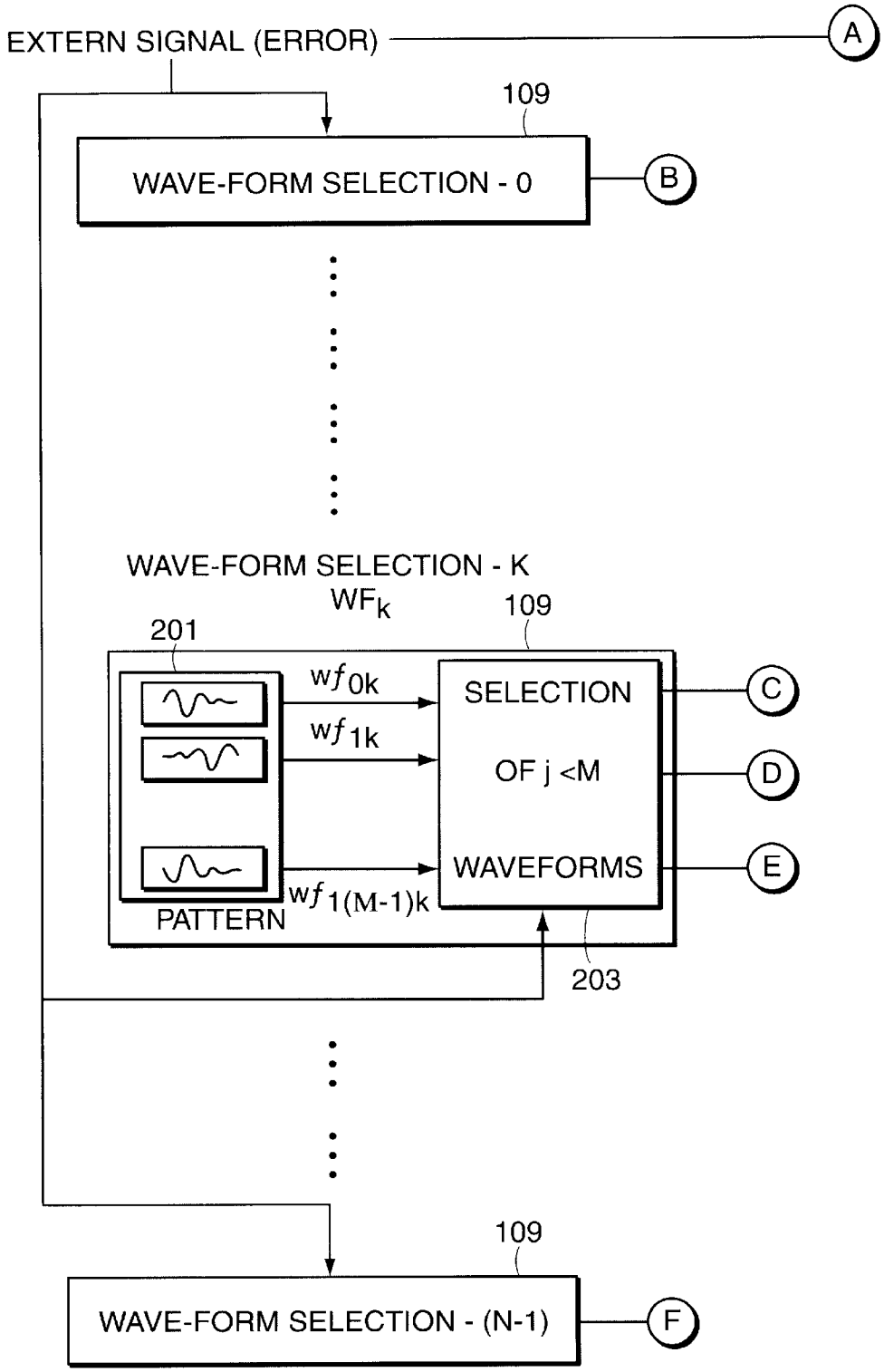
FIG. 2 is a detailed block diagram of excitation signal generation.
Figure 2B:
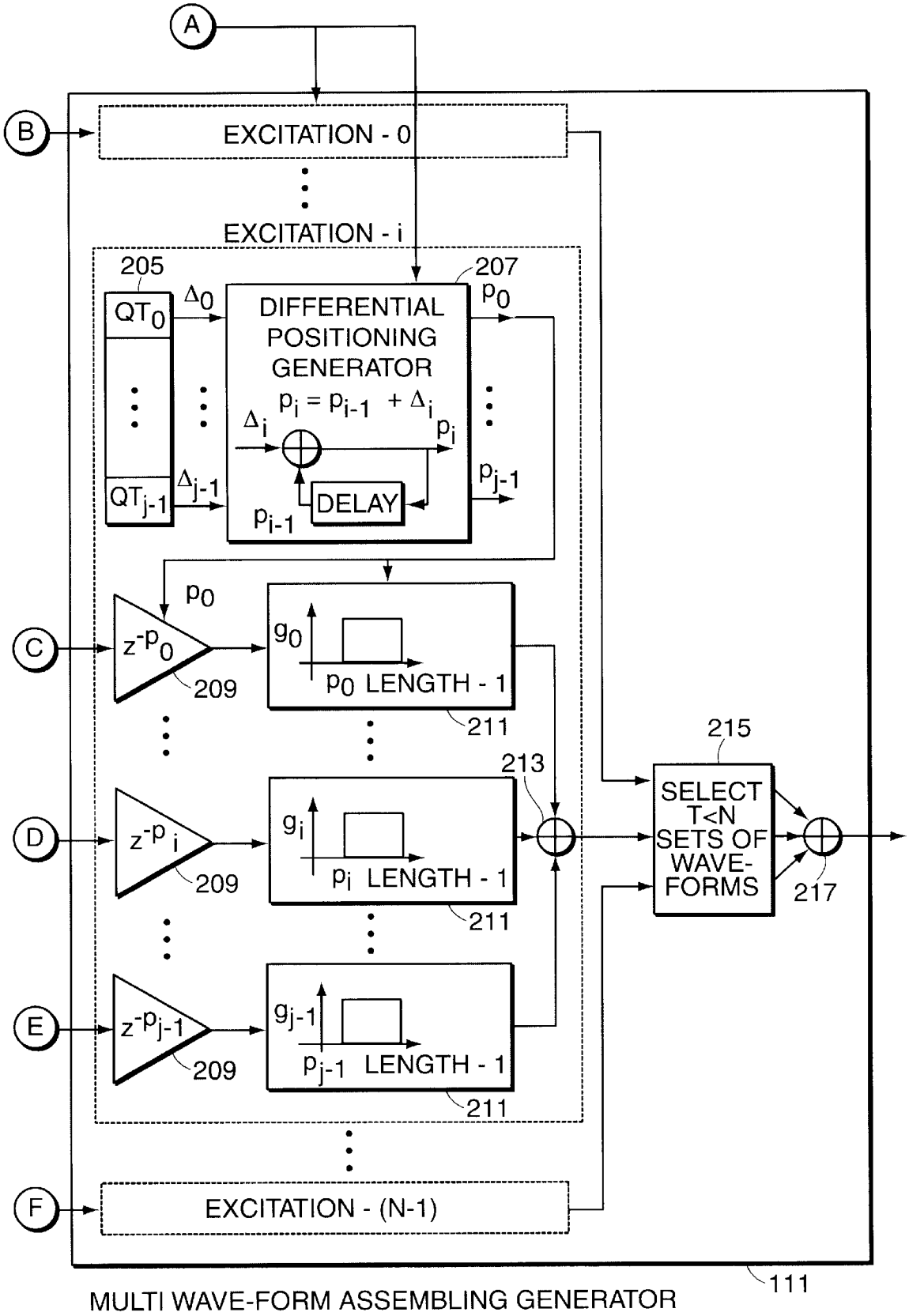

In the particular case of speech, the human voice is physically generated by an excitation sound passing through the vocal chords and the vocal-tract. As the properties of the vocal chords and tract change slowly in time, some kind of redundancy appears on the speech signal. The redundancy in the neighborhood of each sample can be subtracted using a linear predictor 103. The coefficients for this linear predictor are computed using a recursive method in a manner known in the art. These coefficients are quantised and transmitted as a spectral signal that is representative of spectral parameters of the speech to a decoder. For quasi-stationary signals other redundancies can be present, and in particular, for speech signals a pitch value represents well the redundancy introduced by the vibration of the vocal chords. In general, for a quasi-stationary signal, several inter-space parameters are extracted which indicate the most critical redundancies found in this signal, and its evolution, in interspace parameter extractor 105. This information is used afterwards to generate the most likely train of waveforms matching this incoming signal. The high-pass filtered signal is de-emphasized by filter 107 to change the spectral shape so that the acoustical effect introduced by the errors in the model is minimized. The best excitation is selected using a multiple stage system. Several waveforms (WF) are selected in waveform selectors 109, from a bank of different types of waveforms, for example, glottal pulses, sinusoidal periods, single pulses and historical waveform data or any subset of the types of waveforms. One subset, for example, may be simple pulse and historical waveform data. However, a larger variety of waveform types may assist in achieving more accurate encoding, although at potentially higher bit rates. Of course, other waveform types in addition to those mentioned may also be employed. FIG. 2 shows the detailed structure for blocks 109 and 111.

Thus, we define N different sets of waveforms, the kth set being $WF_k$, $0 \leqq k \leqq N-1$. As an example, where we set N=3 and define three different sets of waveforms: a first set of waveforms can model the quasi-stationary excitations where the signal is basically represented by some almost periodic waveforms, encoded using the relative position mechanism; a second set could be defined for non-stationary signals representing the beginning of a sound or a speech burst, being the excitation modeled with a single waveform or a small number of single pulses locally concentrated in time, and thus encoded with the benefit of this knowledge using the relative position method; in general a third set may be defined for non-stationary signals where the spectra are almost flat, and a large number of sparse single pulses can represent this sparse energy for the excitation signal, and they can be efficiently encoded using the relative position system. Each one of these waveform sets contains M different single waveforms, where $wf_{ik}$ represents the ith single waveform included in the kth set of waveforms in 201 and:

$$wf_{ik} \in WF_k, 0 \leqq I \leqq M-1, 0 \leqq k \leqq N-1.$$

For example, in the third set of waveforms, three different single waveforms may be defined: the first one consisting of three samples, wherein the first one has a unity weight, the second one has a double weight, and the third one has also a double weight; the second single waveform consisting of two samples, the first one being a unity pulse, and the second one a "minus one" pulse; and finally, a third single waveform may be defined by a single pulse. The best single waveforms are either pre-selected or dynamically selected as a function of the feedback error caused by the excitation candidate in 203. The selected single waveforms pass through the multiple stage train excitation generator 111. To simplify, we can consider the case in which only one set of waveforms WF enters this block. This set is formed by M different single waveforms, $$wf_i \in WF, 0 \leqq I \leqq M-1.$$

Figure 3:
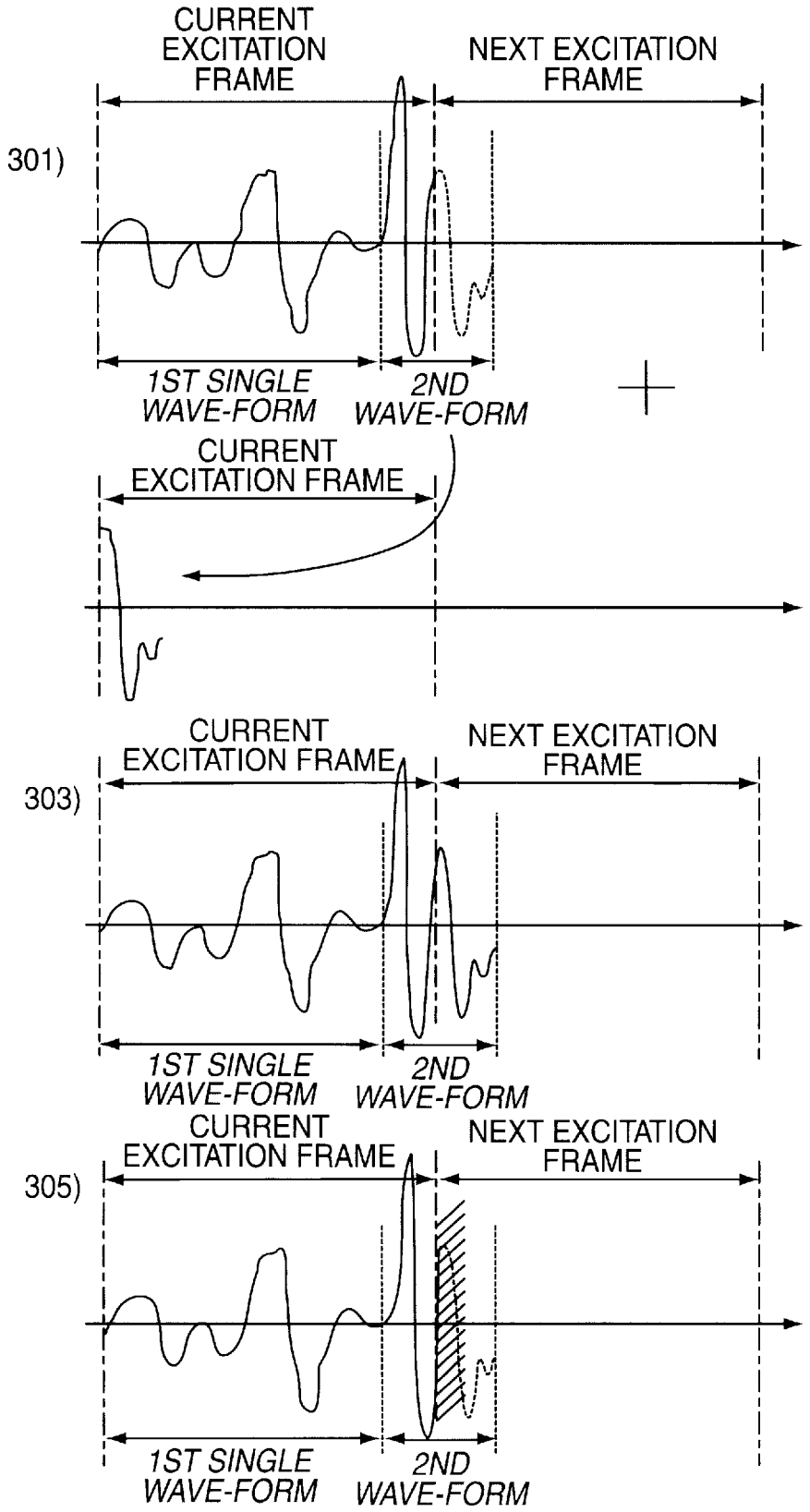
FIG. 3 illustrates various methods to deal with an excitation sequence longer than the current excitation frame.

To create the current excitation candidate for the current excitation frame some single waveforms are assembled to form a sequence. Each single waveform is affected by a gain, and the distances between them (for simplicity, only the "relative" distances between successive single waveforms are considered) are constrained to some sparse values. The length for each of the single waveforms is variable. For this reason, the sequence of single waveforms may go beyond the end of the current excitation frame. FIG. 3 shows different solutions to this problem in the case of only two single waveforms. In the first case 301, the "overflowing"

part of the signal is placed at the beginning of the current excitation frame and added to the existing signal. In a second case 303, the excitation frame continues and the overflowing part of the signal is stored to be applied in the next excitation frame. Finally, in 305, the overflowing part of the signal is discarded and not taken into account in creating the excitation candidate for the current excitation frame.

Thus, the expression for the excitation signal $\hat{s}_k(n)$ may be simplified by considering only the case, as in 305, in which the overflowing part of the signal in the excitation frame is discarded, and also by requiring that the number of single waveforms admitted in the excitation frame is not variable, but limited to j single waveforms in 203. Then, the gain $g_i$ affecting the ith single waveform of the train may be defined. Moreover, $\Delta_i$ is defined as the constrained "relative" distance between the ith single waveform and the (I−1)th single waveform, and for simplicity, $\Delta_0$ is considered an "absolute" position. Due to the fact that the number of single waveforms has been limited, the constraints in the "relative" positions for the j single waveforms may be represented by j different tables, each one having a different number of elements. Thus, the ith quantisation table defined as $QT_i$ in 205 has $NB_POS_i$ different sparse "relative" values, and $\Delta_i$ is constrained to satisfy the condition $\Delta_i \in QT_i[NB_POS_i]$, $0 \leqq I \leqq j-1$. Therefore, the "absolute" positions generated in 207 where the single waveforms can be placed are constrained following the recursion:

$P_0=\Delta_0$ $P_1=(\Delta_0+\Delta_1)$ $P_2=(\Delta_0+\Delta_1+\Delta_2)$

. . .

$P_{i-1}=(\Delta_0+\Delta_1+\Delta_2+ \ldots +\Delta_{i-1})$

. . .

$P_{j-1}=(\Delta_0+\Delta_1+\Delta_2+ \ldots +\Delta_{j-1})$.

Now, the excitation signal $\hat{s}_k(n)$ may be expressed as a function of the single waveforms $wf_i$. Each single waveform is delayed by 209 to its "absolute" position in the excitation frame basis and for each single waveform, a gain and a windowing process is applied by 211. Finally, all the single waveform contributions are added in 213. Mathematically, this concept is expressed:

$$\hat{s}_k(n) = \prod(n) \cdot \sum_{q=0}^{j-1} g_{q wf_{i_q}}(n-p_q) \cdot \prod(n-p_q),$$

where $wf_{i_q} \in WF$, $0 \leqq i_q \leqq M-1$ and where $\Pi(n)$ is the rectangular window defined by:

$$\prod(n) = \begin{cases} 1 \text{ for } 0 \leq n \leq \text{length}-1, \\ 0 \text{ otherwise} \end{cases}$$

and length is the length of the excitation frame basis.

Nevertheless, in general there may be N sets of waveforms, which means there may be N different excitation signals. Among them, T excitation signals are selected in 215, that are mixed in 217, being T<N. Thus, the mixed excitation signal for a generic excitation frame is:

$$\hat{s}(n) = \sum_{k=0}^{T-1} \hat{s}_k(n)$$

where $\hat{s}_k(n)$ corresponds to the kth excitation generated from one set of waveforms.

Each mixed excitation candidate passes through the synthesis LPC filter 113, then it is spectrally shaped by the de-emphasis filter 107 obtaining a new signal $\tilde{s}(n)$, and compared with a reference signal, called $\tilde{s}(n)$, in 121:

$$e(n)=\tilde{s}(n)-\tilde{s}(n).$$

This reference signal $\tilde{s}(n)$ is obtained after subtracting in 117 the contribution of the previous modeled excitation during the current excitation frame, managed in 115. The criteria to select the best mixed excitation sequence is to minimize e(n) using, for example, the least mean squared criteria.

From the above, it can be seen how an excitation signal is produced in accordance with various embodiments of the invention. This excitation signal is combined with the spectral signal referred to above to produce encoded speech in accordance with various embodiments of the invention. The encoded speech may thereafter be decoded in a manner analogous to the encoding, so that the spectral signal defines filters that are used in combination with the excitation signal to recover an approximation of the original speech.

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

What is claimed is:

1. A method of creating an excitation signal associated with a segment of input speech, the method comprising:

a. forming a spectral signal representative of the spectral parameters of the segment of input speech;

b. creating a set of excitation candidate signals, the set having at least one member, each excitation candidate signal comprised of a sequence of single waveforms, each waveform having a type, the sequence having at least one waveform, wherein the position of any single waveform subsequent to the first single waveform is encoded relative to the position of a preceding single waveform;

c. forming a set of error signals, the set having at least one member, each error signal providing a measure of the accuracy with which the spectral signal and a given one of the excitation candidate signals encode the input speech segment;

d. selecting as the excitation signal an excitation candidate for which the corresponding error signal is indicative of sufficiently accurate encoding; and e. if no excitation signal is selected, recursively creating a set of new excitation candidate signals according to step (b) wherein the position of at least one single waveform in the sequence of at least one excitation candidate signal is modified in response to the set of error signals, and repeating steps (c)–(e).

2. A method of creating an excitation signal associated with a segment of input speech as in claim 1, wherein step (a) further includes composing the spectral signal of linear predictive coefficients.

3. A method of creating an excitation signal associated with a segment of input speech according to claim 1, further including extracting from the segment of input speech selected parameters indicative of redundant information present in the segment of input speech.

4. A method of creating an excitation signal associated with a segment of input speech according to claim 3, wherein in step (b), at least one excitation candidate is further responsive to the selected parameters indicative of redundant information present in the segment of input speech.

5. A method of creating an excitation signal associated with a segment of input speech as in claim 1, wherein in step (b), the first single waveform in a given one of the excitation candidate signals is positioned with respect to the beginning of the segment of input speech.

6. A method of creating an excitation signal associated with a segment of input speech as in claim 1, wherein in step (b), the relative positions of subsequent single waveforms are determined dynamically.

7. A method of creating an excitation signal associated with a segment of input speech as in claim 1, wherein in step (b), the relative positions of subsequent single waveforms are determined by use of a table of allowable positions.

8. A method of creating an excitation signal associated with a segment of input speech as in claim 1, wherein in step (b), the single waveforms include at least one of: glottal pulse waveforms, sinusoidal period waveforms, and single pulses.

9. A method of creating an excitation signal associated with a segment of input speech as in claim 1, wherein in step (b), the single waveforms include at least one of: quasi-stationary signal waveforms and non-stationary signal waveforms.

10. A method of creating an excitation signal associated with a segment of input speech as in claim 1, wherein in step (b), the single waveforms include at least one of: substantially periodic waveforms, speech transition sound waveforms, flat spectra waveforms and non-periodic waveforms.

11. A method of creating an excitation signal associated with a segment of input speech as in claim 1, wherein in step (b), the types of single waveforms are pre-selected.

12. A method of creating an excitation signal associated with a segment of input speech as in claim 1, wherein in step (b), the types of single waveforms are dynamically selected.

13. A method of creating an excitation signal associated with a segment of input speech as in claim 12, wherein the dynamic selection of the types of single waveforms is a function of the set of error signals.

14. A method of creating an excitation signal associated with a segment of input speech as in claim 1, wherein in step (b), the single waveforms are variable in length.

15. A method of creating an excitation signal associated with a segment of input speech as in claim 1, wherein in step (b), the single waveforms are fixed in length.

16. A method of creating an excitation signal associated with a segment of input speech as in claim 1, wherein in step (b), the number of single waveforms in the sequence is variable.

17. A method of creating an excitation signal associated with a segment of input speech as in claim 1, wherein in step (b), the number of single waveforms in the sequence is fixed.

18. A method of creating an excitation signal associated with a segment of input speech as in claim 1, wherein step (b) further includes applying any portion of a single waveform extending beyond the end of the current segment of input speech to the beginning of the current segment of input speech.

19. A method of creating an excitation signal associated with a segment of input speech as in claim 1, wherein step (b) further includes applying any portion of a single waveform extending beyond the end of the current segment of input speech to the beginning of the next segment of input speech.

20. A method of creating an excitation signal associated with a segment of input speech as in claim 1, wherein step (b) further includes ignoring any portion of a single waveform extending beyond the end of the current segment of input speech.

21. A method of creating an excitation signal associated with a segment of input speech according to claim 1, wherein in step (b) at least one single waveform is modulated in accordance with a gain factor.

22. A method of creating an excitation signal associated with a segment of input speech as in claim 1, wherein step (c) employs a synthesis filter.

23. An excitation signal generator for use in encoding segments of input speech, the generator comprising:

a. a spectral signal analyzer for forming a spectral signal representative of the spectral parameters of the segment of input speech;

b. an excitation candidate generator for creating a set of excitation candidate signals, the set having at least one member, each excitation candidate signal comprised of a sequence of single waveforms, each waveform having a type, the sequence having at least one waveform, wherein the position of any single waveform subsequent to the first single waveform is encoded relative to the position of a preceding single waveform;

c. an error signal generator for forming a set of error signals, the set having at least one member, each error signal providing a measure of the accuracy with which the spectral signal and a given one of the excitation candidate signals encode the input speech segment;

d. an excitation signal selector for selecting as the excitation signal an excitation candidate signal for which the corresponding error signal is indicative of sufficiently accurate coding; and e. a feedback loop including the excitation candidate generator and the error signal generator configured so that the excitation candidate generator, if no excitation signal is selected, recursively creates a set of new excitation candidate signals such that the position of at least one single waveform in the sequence of at least one excitation candidate signal is modified in response to the set of error signals.

24. An excitation signal generator as in claim 23, wherein the spectral signal analyzer forms the spectral signal with linear predictive coefficients.

25. An excitation signal generator as in claim 23 further including an extractor for extracting from the segment of input speech selected parameters indicative of redundant information present in the segment of input speech.

26. An excitation signal generator as in claim 25, wherein the excitation candidate generator is responsive to the selected parameters indicative of redundant information present in the segment of input speech.

27. An excitation signal generator as in claim 23, wherein the excitation candidate generator positions the first single waveform in at least one excitation candidate signal with respect to the beginning of the segment of input speech.

28. An excitation signal generator as in claim 23, wherein the excitation candidate generator determines the relative positions of subsequent single waveforms dynamically.

29. An excitation signal generator as in claim 23, wherein the excitation candidate generator determines the relative positions of subsequent single waveforms by use of a table of allowable positions.

30. An excitation signal generator as in claim 23, wherein the excitation candidate generator uses single waveforms including at least one of: glottal pulse waveforms, sinusoidal period waveforms, and single pulses.

31. An excitation signal generator as in claim 23, wherein the excitation candidate generator uses single waveforms including at least one of: quasi-stationary signal waveforms and non-stationary signal waveforms.

32. An excitation signal generator as in claim 23, wherein the excitation candidate generator uses single waveforms including at least one of: substantially periodic waveforms, speech transition sound waveforms, flat spectra waveforms and non-periodic waveforms.

33. An excitation signal generator as in claim 23, wherein the excitation candidate generator preselects the types of single waveforms.

34. An excitation signal generator as in claim 23, wherein the excitation candidate generator dynamically selects the types of single waveforms.

35. An excitation signal generator as in claim 34, wherein the dynamic selection of the types of single waveforms is a function of the set of error signals.

36. An excitation signal generator as in claim 23, wherein the excitation candidate generator uses variable length single waveforms.

37. An excitation signal generator as in claim 23, wherein the excitation candidate generator uses fixed length single waveforms.

38. An excitation signal generator as in claim 23, wherein the excitation candidate generator uses a variable number of single waveforms.

39. An excitation signal generator as in claim 23, wherein the excitation candidate generator uses a fixed number of single waveforms.

40. An excitation signal generator as in claim 23, wherein the excitation candidate generator applies any portion of a single waveform extending beyond the end of the current segment of input speech to the beginning of the current segment of input speech.

41. An excitation signal generator as in claim 23, wherein the excitation candidate generator applies any portion of a single waveform extending beyond the end of the current segment of input speech to the beginning of the next segment of input speech.

42. An excitation signal generator as in claim 23, wherein the excitation candidate generator ignores any portion of a single waveform extending beyond the end of the current segment of input speech.

43. An excitation signal generator as in claim 23, wherein the excitation candidate generator modulates at least one single waveform in accordance with a gain factor.

44. A method of creating an excitation signal associated with a segment of input speech, the method comprising:

a. forming a spectral signal representative of the spectral parameters of the segment of input speech;

b. filtering the segment of input speech according to the spectral signal to form a perceptually weighted segment of input speech;

c. producing a reference signal representative of the segment of input speech by subtracting from the perceptually weighted segment of input speech a signal representative of any previous modeled excitation sequence of the current segment of input speech;

d. creating a set of excitation candidate signals, the set having at least one member, each excitation candidate signal comprised of a sequence of single waveforms, each waveform having a type, the sequence having at least one waveform, wherein the position of any single waveform subsequent to the first single waveform is encoded relative to the position of a preceding single waveform;

e. combining a given one of the excitation candidate signals with the spectral signal to form a set of synthetic speech signals, the set having at least one member, each synthetic speech signal representative of the segment of input speech;

f. spectrally shaping each synthetic speech signal to form a set of perceptually weighted synthetic speech signals, the set having at least one member;

g. determining a set of error signals by comparing the reference signal representative of the segment of input speech to each member of the set of perceptually weighted synthetic speech signals;

h. selecting as the excitation signal an excitation candidate signal for which the corresponding error signal is indicative of sufficiently accurate encoding; and i. if no excitation signal is selected, recursively creating a set of new excitation candidate signals according to step (d) wherein the position of at least one single waveform in the sequence of at least one excitation candidate signal is modified in response to the set of error signals, and repeating steps (e)–(i).

45. A method of creating an excitation signal associated with a segment of input speech as in claim 44, wherein step (a) further includes composing the spectral signal of linear predictive coefficients.

46. A method of creating an excitation signal associated with a segment of input speech as in claim 44, wherein step (c) further includes subtracting a contribution due to previously modeled excitation in the current segment of input speech.

47. A method of creating an excitation signal associated with a segment of input speech according to claim 44, further including extracting from the segment of input speech selected parameters indicative of redundant information present in the segment of input speech.

48. A method of creating an excitation signal associated with a segment of input speech according to claim 47, wherein in step (d), the set of excitation candidate signals is further responsive to the selected parameters indicative of redundant information present in the segment of input speech.

49. A method of creating an excitation signal associated with a segment of input speech as in claim 44, wherein in step (d), the first single waveform in a given one of the excitation candidate signals is positioned with respect to the beginning of the segment of input speech.

50. A method of creating an excitation signal associated with a segment of input speech as in claim 44, wherein in step (d), the relative positions of subsequent single waveforms are determined dynamically.

51. A method of creating an excitation signal associated with a segment of input speech as in claim 44, wherein in step (d), the relative positions of subsequent single waveforms are determined by use of a table of allowable positions.

52. A method of creating an excitation signal associated with a segment of input speech as in claim 44, wherein in step (d), the single waveforms include at least one of: glottal pulse waveforms, sinusoidal period waveforms, and single pulses.

53. A method of creating an excitation signal associated with a segment of input speech as in claim 44, wherein in step (d), the single waveforms include at least one of: quasi-stationary signal waveforms and non-stationary signal waveforms.

54. A method of creating an excitation signal associated with a segment of input speech as in claim 44, wherein in step (d), the single waveforms include at least one of: substantially periodic waveforms, speech transition sound waveforms, flat spectra waveforms and non-periodic waveforms.

55. A method of creating an excitation signal associated with a segment of input speech as in claim 44, wherein in step (d), the types of single waveforms are pre-selected.

56. A method of creating an excitation signal associated with a segment of input speech as in claim 44, wherein in step (d), the types of single waveforms are dynamically selected.

57. A method of creating an excitation signal associated with a segment of input speech as in claim 56, wherein the dynamic selection of the types of single waveforms is a function of the set of error signals.

58. A method of creating an excitation signal associated with a segment of input speech as in claim 44, wherein in step (d), the single waveforms are variable in length.

59. A method of creating an excitation signal associated with a segment of input speech as in claim 44, wherein in step (d), the single waveforms are fixed in length.

60. A method of creating an excitation signal associated with a segment of input speech as in claim 44, wherein in step (d), the number of single waveforms in the sequence is variable.

61. A method of creating an excitation signal associated with a segment of input speech as in claim 44, wherein in step (d), the number of single waveforms in the sequence is fixed.

62. A method of creating an excitation signal associated with a segment of input speech as in claim 44, wherein step (d) further includes applying any portion of a single waveform extending beyond the end of the current segment of input speech to the beginning of the current segment of input speech.

63. A method of creating an excitation signal associated with a segment of input speech as in claim 44, wherein step (d) further includes applying any portion of a single waveform extending beyond the end of the current segment of input speech to the beginning of the next segment of input speech.

64. A method of creating an excitation signal associated with a segment of input speech as in claim 44, wherein step (d) further includes ignoring any portion of a single waveform extending beyond the end of the current segment of input speech.

65. A method of creating an excitation signal associated with a segment of input speech as in claim 44, wherein in step (d) at least one single waveform is modulated in accordance with a gain factor.

66. A method of creating an excitation signal associated with a segment of input speech as in claim 44, wherein step (e) employs a synthesis filter.

67. A method of creating an excitation signal associated with a segment of input speech as in claim 44, wherein step (f) employs a de-emphasis filter.

68. An excitation signal generator for use in encoding segments of input speech, the generator comprising:

a. a spectral signal analyzer for forming a spectral signal representative of the spectral parameters of the segment of input speech;

b. a de-emphasis filter which filters the segment of input speech according to the spectral signal to form a perceptually weighted segment of input speech;

c. a reference signal generator which produces a reference signal representative of the segment of input speech by subtracting from the perceptually weighted segment of input speech a signal representative of any previously modeled excitation sequence of the current segment of input speech;

d. an excitation candidate generator for creating a set of excitation candidate signals, the set having at least one member, each excitation candidate signal comprised of a sequence of single waveforms, each waveform having a type, the sequence having at least one waveform, wherein the position of any single waveform subsequent to the first single waveform is encoded relative to the position of a preceding single waveform;

e. a synthesis filter which combines a given one of the excitation candidate signals with the spectral signal to form a set of synthetic speech signals, the set having at least one member, each synthetic speech signal representative of the segment of input speech;

f. a spectral shaping filter which shapes each synthetic speech signal to form a set of perceptually weighted synthetic speech signals, the set having at least one member;

g. a signal comparator which determines a set of error signals by comparing the reference signal representative of the segment of input speech to each member of the set of perceptually weighted synthetic speech signals;

h. an excitation signal selector for selecting as the excitation signal an excitation candidate signal for which the corresponding error signal is indicative of sufficiently accurate encoding; and i. a feedback loop including the excitation candidate generator and the error signal generator configured so that the excitation candidate generator, if no excitation signal is selected, recursively creates a set of new excitation candidate signals such that the position of at least one single waveform in the sequence of at least one excitation candidate signal is modified in response to the set of error signals.

69. An excitation signal generator as in claim 68, wherein the spectral signal analyzer forms the spectral signal with linear predictive coefficients.

70. An excitation signal generator as in claim 68, wherein the reference signal generator further includes means for subtracting a contribution due to previously modeled excitation in the current segment of input speech.

71. An excitation signal generator as in claim 68 further including an extractor for extracting from the segment of input speech selected parameters indicative of redundant information present in the segment of input speech.

72. An excitation signal generator as in claim 71, wherein the excitation candidate generator is responsive to the selected parameters indicative of redundant information present in the segment of input speech.

73. An excitation signal generator as in claim 68, wherein the excitation candidate generator positions the first single waveform in a given one of the excitation candidate signals with respect to the beginning of the segment of input speech.

74. An excitation signal generator as in claim 68, wherein the excitation candidate generator determines the relative positions of subsequent single waveforms dynamically.

75. An excitation signal generator as in claim 68, wherein the excitation candidate generator determines the relative positions of subsequent single waveforms by use of a table of allowable positions.

76. An excitation signal generator as in claim 68, wherein the excitation candidate generator uses single waveforms including at least one of: glottal pulse waveforms, sinusoidal period waveforms, and single pulses.

77. An excitation signal generator as in claim 68, wherein the excitation candidate generator uses single waveforms including at least one of: quasi-stationary signal waveforms and non-stationary signal waveforms.

78. An excitation signal generator as in claim 68, wherein the excitation candidate generator uses single waveforms including at least one of: substantially periodic waveforms, speech transition sound waveforms, flat spectra waveforms and non-periodic waveforms.

79. An excitation signal generator as in claim 68, wherein the excitation candidate generator pre-select the types of single waveforms.

80. An excitation signal generator as in claim 68, wherein the excitation candidate generator dynamically selects the types of single waveforms.

81. An excitation signal generator as in claim 80, wherein the dynamic selection of the types of single waveforms is a function of the set of error signals.

82. An excitation signal generator as in claim 68, wherein the excitation candidate generator uses variable length single waveforms.

83. An excitation signal generator as in claim 68, wherein the excitation candidate generator uses fixed length single waveforms.

84. An excitation signal generator as in claim 68, wherein the excitation candidate generator uses a variable number of single waveforms.

85. An excitation signal generator as in claim 68, wherein the excitation candidate generator uses a fixed number of single waveforms.

86. An excitation signal generator as in claim 68, wherein the excitation candidate generator applies any portion of a single waveform extending beyond the end of the current segment of input speech to the beginning of the current segment of input speech.

87. An excitation signal generator as in claim 68, wherein the excitation candidate generator applies any portion of a single waveform extending beyond the end of the current segment of input speech to the beginning of the next segment of input speech.

88. An excitation signal generator as in claim 68, wherein the excitation candidate generator ignores any portion of a single waveform extending beyond the end of the current segment of input speech.

89. An excitation signal generator as in claim 68, wherein the excitation candidate generator modulates at least one single waveform in accordance with a gain factor.

90. A method of creating an excitation signal associated with a segment of input speech, the method comprising:

a. forming a spectral signal representative of the spectral parameters of the segment of input speech;

b. creating a set of excitation candidate signals, the set having at least one member, each excitation candidate signal composed of members from a plurality of sets of excitation sequences, wherein each excitation sequence is comprised of a sequence of single waveforms, each waveform having a type, the sequence having at least one waveform, wherein the position of any single waveform subsequent to the first single waveform is encoded relative to the position of a preceding single waveform;

c. forming a set of error signals, the set having at least one member, each error signal providing a measure of the accuracy with which the spectral signal and a given one of the excitation candidate signals encode the input speech segment;

d. selecting as the excitation signal an excitation candidate signal for which the corresponding error signal is indicative of sufficiently accurate encoding; and e. if no excitation signal is selected, recursively creating a set of new excitation candidate signals according to step (b) wherein the position of at least one single waveform in at least one of the excitation sequences is modified in response to the error signal, and repeating steps (c)–(e).

91. A method of creating an excitation signal associated with a segment of input speech as in claim 90, wherein step (a) further includes composing the spectral signal of linear predictive coefficients.

92. A method of creating an excitation signal associated with a segment of input speech according to claim 90, further including extracting from the segment of input speech selected parameters indicative of redundant information present in the segment of input speech.

93. A method of creating an excitation signal associated with a segment of input speech according to claim 92, wherein in step (b), at least one of the excitation sequences is further responsive to the selected parameters indicative of redundant information present in the segment of input speech.

94. A method of creating an excitation signal associated with a segment of input speech as in claim 90, wherein step (b) further includes positioning the first single waveform in each excitation sequence with respect to the beginning of the segment of input speech.

95. A method of creating an excitation signal associated with a segment of input speech as in claim 90, wherein in step (b), in at least one excitation sequence the relative positions of subsequent single waveforms are determined dynamically.

96. A method of creating an excitation signal associated with a segment of input speech as in claim 90, wherein in step (b), in at least one excitation sequence the relative positions of subsequent single waveforms are determined by use of a table of allowable positions.

97. A method of creating an excitation signal associated with a segment of input speech as in claim 90, wherein in step (b), the single waveforms include at least one of: glottal pulse waveforms, sinusoidal period waveforms, and single pulses.

98. A method of creating an excitation signal associated with a segment of input speech as in claim 90, wherein in step (b), the single waveforms include at least one of: quasi-stationary signal waveforms and non-stationary signal waveforms.

99. A method of creating an excitation signal associated with a segment of input speech as in claim 90, wherein in step (b), the single waveforms include at least one of: substantially periodic waveforms, speech transition sound waveforms, flat spectra waveforms and non-periodic waveforms.

100. A method of creating an excitation signal associated with a segment of input speech as in claim 90, wherein in step (b), the types of single waveforms are pre-selected for at least one of the excitation sequences.

101. A method of creating an excitation signal associated with a segment of input speech as in claim 90, wherein in step (b), the types of single waveforms are dynamically selected for at least one of the excitation sequences.

102. A method of creating an excitation signal associated with a segment of input speech as in claim 101, wherein the dynamic selection of the types of single waveforms is a function of the set of error signals.

103. A method of creating an excitation signal associated with a segment of input speech as in claim 90, wherein in step (b), the single waveforms are variable in length.

104. A method of creating an excitation signal associated with a segment of input speech as in claim 90, wherein in step (b), the single waveforms are fixed in length.

105. A method of creating an excitation signal associated with a segment of input speech as in claim 90, wherein in step (b), the number of single waveforms in at least one of the excitation sequences is variable.

106. A method of creating an excitation signal associated with a segment of input speech as in claim 90, wherein in step (b), the number of single waveforms in at least one of the excitation sequences is fixed.

107. A method of creating an excitation signal associated with a segment of input speech as in claim 90, wherein, for at least one of the excitation sequences, step (b) further includes applying any portion of a single waveform extending beyond the end of the current segment of input speech to the beginning of the current segment of input speech.

108. A method of creating an excitation signal associated with a segment of input speech as in claim 90, wherein, for at least one of the excitation sequences, step (b) further includes applying any portion of a single waveform extending beyond the end of the current segment of input speech to the beginning of the next segment of input speech.

109. A method of creating an excitation signal associated with a segment of input speech as in claim 90, wherein, for at least one of the excitation sequences, step (b) further includes ignoring any portion of a single waveform extending beyond the end of the current segment of input speech.

110. A method of creating an excitation signal associated with a segment of input speech according to claim 90, wherein in step (b) at least one of the plurality of sets of excitation sequences is associated with preselected redundancy information.

111. A method of creating an excitation signal associated with a segment of input speech according to claim 110, wherein the preselected redundancy information is pitch related information.

112. A method of creating an excitation signal associated with a segment of input speech according to claim 90, wherein in step (b) at least one single waveform is modulated in accordance with a gain factor.

113. A method of creating an excitation signal associated with a segment of input speech as in claim 90, wherein step (c) employs a synthesis filter.

114. An excitation signal generator for use in encoding segments of input speech, the generator comprising:

a. a spectral signal analyzer for forming a spectral signal representative of the spectral parameters of the segment of input speech;

b. an excitation candidate generator for creating a set of excitation candidate signals, the set having at least one member, each excitation candidate signal composed of members from a plurality of sets of excitation sequences, wherein each excitation sequence is comprised of a sequence of single waveforms, each waveform having a type, the sequence having at least one waveform, wherein the position of any single waveform subsequent to the first single waveform is encoded relative to the position of a preceding single waveform;

c. an error signal generator for forming a set of error signals, the set having at least one member, each error signal providing a measure of the accuracy with which the spectral signal and a given one of the excitation candidate signals encode the input speech segment;

d. an excitation signal selector for selecting as the excitation signal an excitation candidate signal for which the corresponding error signal is indicative of sufficiently accurate encoding; and e. a feedback loop including the excitation candidate generator and the error signal generator configured so that the excitation candidate generator, if no excitation signal is selected, recursively creates a set of new excitation candidate signals such that the position of at least one single waveform in the sequence of at least one excitation candidate signal is modified in response to the set of error signals.

115. An excitation signal generator as in claim 114, wherein the spectral signal analyzer forms the spectral signal with linear predictive coefficients.

116. An excitation signal generator as in claim 114 further including an extractor for extracting from the segment of input speech selected parameters indicative of redundant information present in the segment of input speech.

117. An excitation signal generator as in claim 114, wherein the excitation candidate generator is responsive in at least one of the excitation sequences to the selected parameters indicative of redundant information present in the segment of input speech.

118. An excitation signal generator as in claim 114, wherein the excitation candidate generator positions the first single waveform in each excitation sequence with respect to the beginning of the segment of input speech.

119. An excitation signal generator as in claim 114, wherein the excitation candidate generator determines the relative positions of subsequent single waveforms in at least one of the excitation sequences dynamically.

120. An excitation signal generator as in claim 114, wherein the excitation candidate generator determines the relative positions of subsequent single waveforms in at least one of the excitation sequences by use of a table of allowable positions.

121. An excitation signal generator as in claim 114, wherein the excitation candidate generator uses single waveforms including at least one of: glottal pulse waveforms, sinusoidal period waveforms, and single pulses.

122. An excitation signal generator as in claim 114, wherein the excitation candidate generator uses single waveforms including at least one of: quasi-stationary signal waveforms and non-stationary signal waveforms.

123. An excitation signal generator as in claim 114, wherein the excitation candidate generator uses single waveforms including at least one of: substantially periodic waveforms, speech transition sound waveforms, flat spectra waveforms and non-periodic waveforms.

124. An excitation signal generator as in claim 114, wherein the excitation candidate generator pre-select the types of single waveforms for at least one of the excitation sequences.

125. An excitation signal generator as in claim 114, wherein the excitation candidate generator dynamically selects the types of single waveforms for at least one of the excitation sequences.

126. An excitation signal generator as in claim 125, wherein the dynamic selection of the types of single waveforms is a function of the set of error signals.

127. An excitation signal generator as in claim 114, wherein the excitation candidate generator uses variable length single waveforms.

128. An excitation signal generator as in claim 114, wherein the excitation candidate generator uses fixed length single waveforms.

129. An excitation signal generator as in claim 114, wherein the excitation candidate generator uses a variable number of single waveforms in at least one of the excitation sequences.

130. An excitation signal generator as in claim 114, wherein the excitation candidate generator uses a fixed number of single waveforms in at least one of the excitation sequences.

131. An excitation signal generator as in claim 114, wherein the excitation candidate generator in at least one of the excitation sequences applies any portion of a single waveform extending beyond the end of the current segment of input speech to the beginning of the current segment of input speech.

132. An excitation signal generator as in claim 114, wherein the excitation candidate generator in at least one of the excitation sequences applies any portion of a single waveform extending beyond the end of the current segment of input speech to the beginning of the next segment of input speech.

133. An excitation signal generator as in claim 114, wherein the excitation candidate generator in at least one of the excitation sequences ignores any portion of a single waveform extending beyond the end of the current segment of input speech.

134. An excitation signal generator as in claim 114, wherein in the excitation candidate generator at least one of the plurality of sets of excitation sequences is associated with preselected redundancy information.

135. An excitation signal generator as in claim 134, wherein the preselected redundancy information is pitch related information.

136. An excitation signal generator as in claim 132, wherein the excitation candidate generator modulates at least one single waveform in accordance with a gain factor.

* * * * *

UNITED STATES PATENT AND TRADEMARK OFFICE

CERTIFICATE OF CORRECTION

PATENT NO. : 5,963,897

DATED : October 5, 1999

INVENTOR(S) : Alpuente el al.

It is certified that error appears in the above-identified patent and that said Letters Patent is hereby corrected as shown below:

Column 15, line 11, change "pre-select" to "pre-selects"
Column 18, line 48, change "pre-select" to "pre-selects"

Signed and Sealed this

Thirtieth Day of May, 2000

*Attest:*

*Attesting Officer*

Q. TODD DICKINSON

*Director of Patents and Trademarks*